United States Patent [19]

D'Aquila et al.

[11] Patent Number: 5,009,354

[45] Date of Patent: Apr. 23, 1991

[54] AUTOMATIC RIVETING MACHINE

[75] Inventors: Anthony D'Aquila, Trumbull; Charles F. Smart; Raymond H. Varian, both of Danbury, all of Conn.

[73] Assignee: Emhart Inc., Towson, Md.

[21] Appl. No.: 445,079

[22] Filed: Dec. 1, 1989

[51] Int. Cl.[5] ..... B21J 15/10

[52] U.S. Cl. ..... 227/2; 227/3; 227/5; 227/117

[58] Field of Search ..... 227/2, 3, 112, 116, 227/118, 117, 5, 6, 1

[56] References Cited

U.S. PATENT DOCUMENTS

| | | | |
|---|---|---|---|
| 4,721,228 | 1/1988 | Bejerano | 221/13 |
| 4,754,643 | 7/1988 | Weeks, Jr. et al. | 72/391 |
| 4,790,470 | 12/1988 | Miles | 227/1 |
| 4,811,881 | 3/1989 | Heck | 227/4 |
| 4,907,718 | 3/1990 | Emmerich | 221/1 |

*Primary Examiner*—Hien H. Phan
*Assistant Examiner*—John M. Husar
*Attorney, Agent, or Firm*—Spencer T. Smith

[57] ABSTRACT

Rivets are delivered from a feed chute to a transfer location and blown through a feed tube to a loading device. The presence of a rivet is sensed both at the transfer location and at the loading device and a fault indicator is operated in the event a rivet sensed and transported from the transfer location does not wind up in the loading device. The operator hits the reset button which blows clean air thru the feed tube in an attempt to free the jammed rivet. In the event this does not occur, the system assumes the operator cleared the jam and loads the next rivet into position to be transferred and continues the cycle.

6 Claims, 3 Drawing Sheets

AUTOMATIC RIVETING MACHINE

The present invention relates to automatic riveting machines such as disclosed in U.S. Pat. Nos. 4,747,294 and 4,754,643 wherein rivets are delivered one at a time to a loading device which inserts the rivets into a rivet tool.

Rivet feed systems normally present rivets in single file (parallel to one another) in a feed track or chute which is periodically supplied by a rivet feeder bowl. The rivets are fed one at a time through a rivet feed tube to a locating device which advance to a load position where the rivet will be transferred to the rivet gun.

When a rivet is not loaded into the rivet gun the operator's productivity will be dependent upon the data that he receives. If he knows that the rivet is hung up in the rivet feed tube he can promptly address that problem minimizing his downtime.

It is accordingly an object of the present invention to provide information for the operator telling him when a rivet has not been loaded into the rivet gun because of a problem in the rivet feed tube.

Other objects and advantages of the present invention will become apparent from the following portion of this specification and from the accompanying drawings which illustrate in accordance with the mandate of the patent statutes, a presently preferred embodiment incorporating the principles of the invention. Referring to the drawings.

Figure 1:
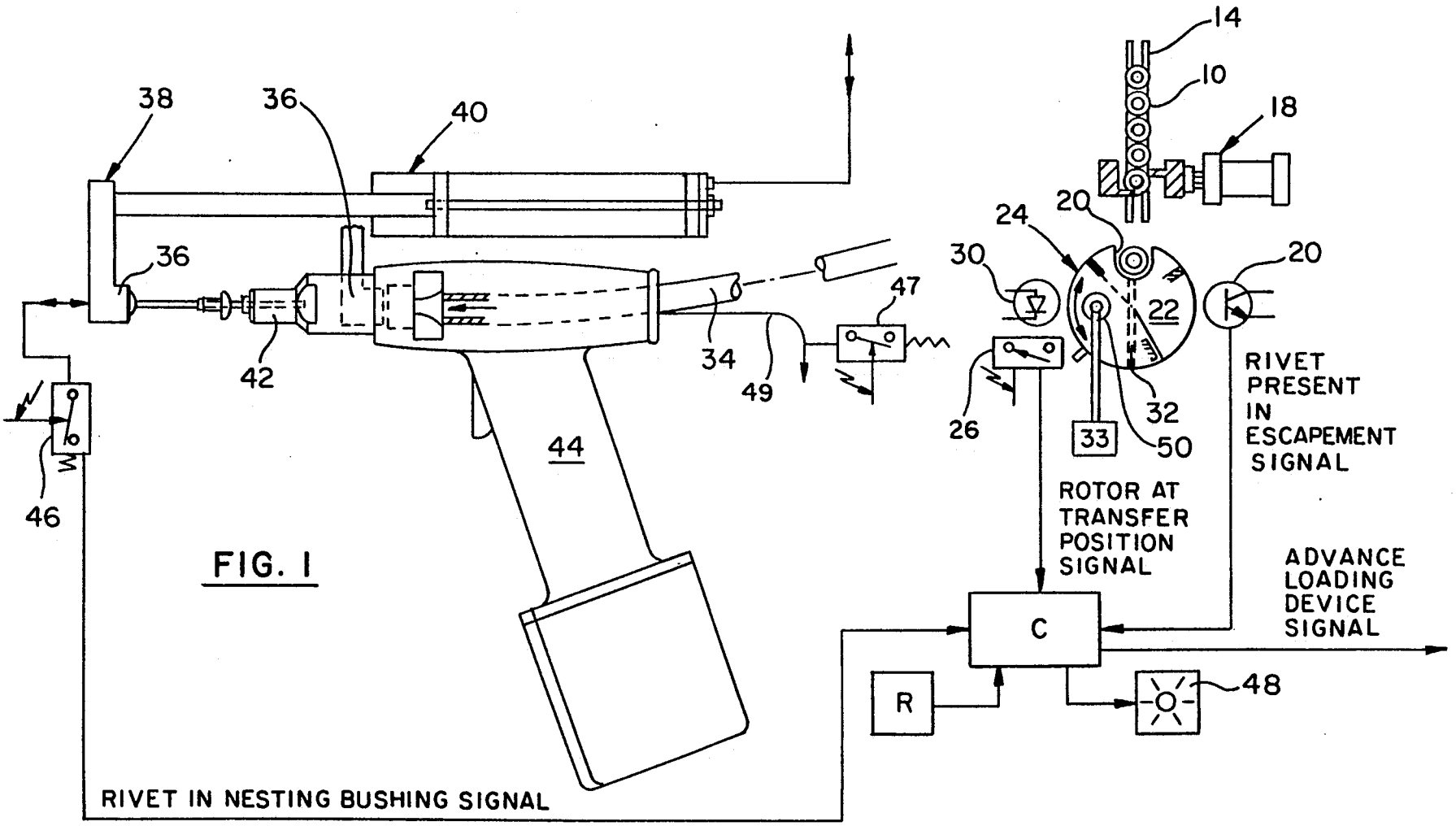
FIG. 1 is a schematic representation of a portion of an automatic riveting machine made in accordance with the teachings of the present invention.

A supply of rivets 10 contained in a feed track or chute 14 are released, one at a time, by a gating mechanism 18. The released rivet is received within an axial channel 20 defined in the cylindrical rotor 22 of an escapement mechanism 24.

The rotor indexes 90 degrees from its receiving orientation to its transfer orientation (sensed by a proximity switch 26 which issues a Rotor At Transfer Position Signal) and the presence of a rivet in the axial channel 20 at the transfer location is confirmed by a light sensor 28 which will go dark as a result of the rivet blocking light transmission from a light source 30 through a diametral bore 32 in the rotor and issue a Rivet Present In Escapement Signal Air under pressure from a source 33 is then connected to blow the rivet from the escapement rotor and through the rivet feed tube 34 to the retracted nesting bushing 36R (shown in phantom) of the extendable pivot arm 38 of the presenting or loading device 40. The nesting bushing 36 is under a vacuum which pulls the rivet into the nesting bushing A vacuum switch 46 senses the presence of the rivet in the nesting bushing and generates a Rivet Present In Nesting Bushing Signal and responding to this signal the controller issues an Advance Loading Device Signal whereupon the arm 38 is extended and pivoted to the feed position The vacuum is then removed and pressure is applied to blow the rivet into the nose 42 of the rivet tool 44.

Figure 2:
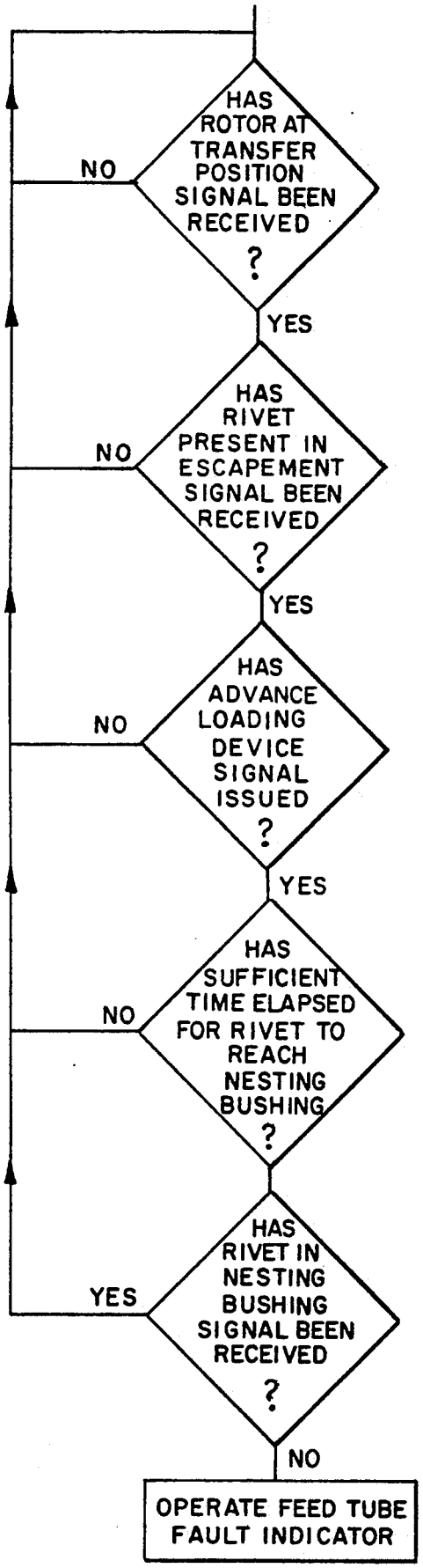
FIG. 2 is part of a flow chart illustrating the control of rivet feed to the gun of an automatic riveting machine illustrated in FIG. 1.
Figure 3:
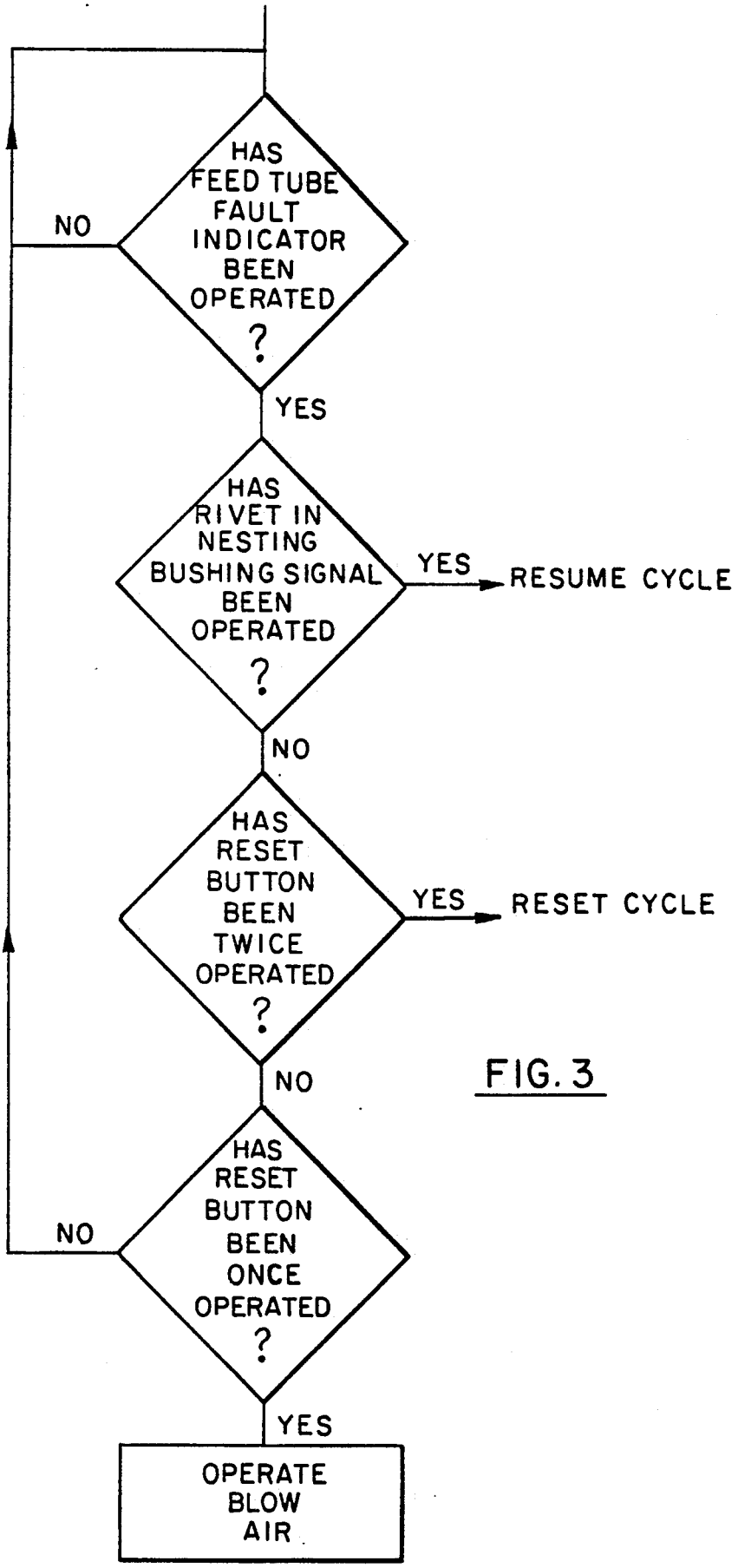
FIG. 3 is another part of the flow chart illustrating the control of rivet feed to the feed track.

In operation (see FIG. 2) when the controller C receives the Rivet Present In Escapement Signal and the Rotor At Transfer Position Signal it turns on the source of clean air under pressure 33 to blow the rivet through the rivet feed tube into the nesting bushing 36. After an interval of time sufficient for the rivet to reach the nesting bushing, the controller looks to receive the Rivet In Nesting Bushing Signal. When the signal is not received, the controller operates a suitable fault indicator 48 telling the operator that while a rivet had been located at the rotor transfer position, it had not reached the nesting bushing. The rotor then indexes back to its original rivet receiving position to receive the next rivet. When the operator hits the reset button R, the controller will again operate the source of air under pressure 33 blowing clean air under pressure through a blow hole 50 which is defined in the rotor and which will connect the source of clean air to the feed tube when the rotor is at the rivet receiving position. (Alternately the rotor, prior to receiving the next rivet could index back to the transfer position) to blow a rivet stuck in the rivet feed tube through the remaining portion of the tube and into the bushing. If at any time the rivet clears and reaches the nesting bushing the fault light will turn off and the cycle will continue. If this does not result in the rivet reaching the nesting bushing, the source of air under pressure will be turned off; the controller will assume that the operator has cleaned the system and will receive the next rivet and index the escapement rotor to the transfer position whereupon the source of pressurized air will again be connected to transfer the next rivet to the nesting bushing.

We claim:

1. A rivet setting machine comprising a rivet tool for setting rivets, a loading device for loading individual rivets into said rivet tool, said loading device including rivet receiving means means for delivering a rivet to said rivet receiving means including means for presenting a rivet at a transfer position, means for verifying that a rivet is at said transfer position, feed tube means, pressurized air means for transferring a rivet presented at the transfer position through said feed tube means to said rivet receiving means, means for actuating said pressurized air means, means for determining that a rivet has transferred from said transfer position to said rivet receiving means, means for generating a fault signal in the event said determining means fails to determine that a rivet has transferred from said presenting means to said rivet receiving means to indicate that the rivet is between said receiving means and said transfer position, means for again operating said pressurized air means in the event said fault signal is generated, and means for again operating said presenting means in the event a rivet is not received by said rivet receiving means and operating said pressurized air means for the third time when the next rivet is located at said transfer position.

2. A rivet setting machine according to claim 1, wherein said presenting means comprises an escapement mechanism including a rotor having a rivet receiving channel and means for indexing said rotor to displace said channel from a rivet receiving position to a second position whereat the received rivet will be presented at said transfer position.

3. A rivet setting machine according to claim 2, wherein said presenting means further comprises a diametral hole defined in said rotor adapted to be blocked by a received component, light source means at one end of the selectively located diametral hole and light sensor means at the other end of the selectively located diametral hole for sensing said light source means in the event a rivet is missing from said rotor.

4. A rivet setting machine according to claim 2 wherein said rotor includes thru-hole means selectively located to be in alignment with said feed tube means when said rotor is at said rivet receiving position said pressurized air means communicating with said thru-hole means when said rotor is at said rivet receiving position.

5. A rivet setting machine according to claim 1 further comprising means for enabling said actuating means in the event said fault signed is generated so that the operator can again operate said actuating means.

6. A rivet setting machine according to claim 1, wherein said means for again operating said pressurized air means includes a reset button.

* * * * *